US009713798B2

(12) United States Patent
Hewitt et al.

(10) Patent No.: US 9,713,798 B2
(45) Date of Patent: Jul. 25, 2017

(54) APPARATUS FOR REGULATING A TEMPERATURE OF A FLUID IN A CONTAINER, AND AERATING AND DISPENSING THE FLUID

(71) Applicant: HEWY WINE CHILLERS, LLC, Orlando, FL (US)

(72) Inventors: Benjamin R. Hewitt, Orlando, FL (US); Roy Paul Prosise, Cedar Park, TX (US); Dan Caputo, Cedar Park, TX (US); Benjamin D. Litteral, Austin, TX (US)

(73) Assignee: HEWY WINE CHILLERS, LLC, Orlando, FL (US)

( * ) Notice: Subject to any disclaimer, the term of this patent is extended or adjusted under 35 U.S.C. 154(b) by 32 days.

(21) Appl. No.: 14/654,474

(22) PCT Filed: Jan. 2, 2014

(86) PCT No.: PCT/US2014/010069
§ 371 (c)(1),
(2) Date: Jun. 19, 2015

(87) PCT Pub. No.: WO2014/107508
PCT Pub. Date: Jul. 10, 2014

(65) Prior Publication Data

US 2015/0328600 A1 Nov. 19, 2015

Related U.S. Application Data

(60) Provisional application No. 61/748,830, filed on Jan. 4, 2013.

(51) Int. Cl.
*B67D 7/76* (2010.01)
*B01F 5/04* (2006.01)
(Continued)

(52) U.S. Cl.
CPC ..... *B01F 5/0413* (2013.01); *B01F 3/04794* (2013.01); *B01F 5/0428* (2013.01);
(Continued)

(58) Field of Classification Search
CPC .. B01F 5/0413; B01F 3/04794; B01F 5/0428; B01F 15/066
(Continued)

(56) References Cited

U.S. PATENT DOCUMENTS 298,694 A 5/1884 Jewett
528,463 A 10/1894 Busch
(Continued)

FOREIGN PATENT DOCUMENTS

CN 2852868 Y 1/2007
CN 1918049 A 2/2007
(Continued)

OTHER PUBLICATIONS

Winesceptre, "Winesceptre—Wine Chilling System," available on the web at: http://www.thegreenhead.com/2008/10/winesceptre-wine-chilling-system.php, archive.org/web/ (Wayback Machine) shows date as Oct. 28, 2008, 1 page.*
(Continued)

*Primary Examiner* — Patrick M Buechner
*Assistant Examiner* — Jeremy W Carroll

(57) ABSTRACT

An apparatus for regulating a temperature of a fluid inside a container, and aerating and dispensing the fluid from the container is disclosed. The apparatus has a body that contacts the fluid inside the container. The apparatus includes an axis, a cavity, a fluid inlet, and an air outlet. A second fluid is located and sealed inside the cavity. An aerator separates the fluid inlet from the air outlet. The aerator includes a channel to the fluid inlet through which fluid flows out of the aerator, an air inlet through which air flows to the air outlet
(Continued)

and into the container, and a passage from the air inlet into the channel to aerate the fluid.

19 Claims, 11 Drawing Sheets

(51) Int. Cl.

| | |
|---|---|
| ***B01F 3/04*** | (2006.01) |
| ***B01F 13/00*** | (2006.01) |
| ***B65D 81/18*** | (2006.01) |
| ***B65D 47/32*** | (2006.01) |
| ***B01F 15/06*** | (2006.01) |

(52) U.S. Cl.
CPC ..... *B01F 13/002* (2013.01); *B01F 15/066* (2013.01); *B65D 47/32* (2013.01); *B65D 81/18* (2013.01); *B01F 2015/061* (2013.01); *B01F 2215/0072* (2013.01)

(58) Field of Classification Search
USPC ..... 222/190, 146.6, 183, 130, 131
See application file for complete search history.

(56) References Cited

U.S. PATENT DOCUMENTS

| | | | | |
|---|---|---|---|---|
| D30,832 | S | 5/1899 | Lowrey | |
| D30,833 | S | 5/1899 | Lowrey | |
| 1,030,325 | A * | 6/1912 | Peoples | F25D 31/006 220/521 |
| D92,580 | S | 6/1934 | Caplan | |
| D101,785 | S | 11/1936 | Liebeshutz | |
| 2,164,314 | A | 7/1939 | Edwards | |
| D122,941 | S | 10/1940 | Grunberg | |
| D135,105 | S | 2/1943 | Moran | |
| 2,669,370 | A | 2/1954 | Royall | |
| 2,734,358 | A | 2/1956 | Himmelfarb | |
| 2,746,265 | A * | 5/1956 | Mills | B65D 51/24 62/293 |
| 2,749,719 | A | 6/1956 | Copeman | |
| 3,059,452 | A * | 10/1962 | Griffin | F25D 3/08 62/457.2 |
| 3,161,031 | A | 12/1964 | Flannery | |
| 3,241,724 | A | 3/1966 | Lerner | |
| 3,320,767 | A | 5/1967 | Whalen | |
| D224,748 | S | 9/1972 | Duher | |
| 4,402,195 | A | 9/1983 | Campbell | |
| 4,478,346 | A | 10/1984 | Spong | |
| 4,531,383 | A | 7/1985 | Zimmerman | |
| 4,599,872 | A | 7/1986 | Rist | |
| 4,702,396 | A | 10/1987 | Gwiazda | |
| 4,735,063 | A | 4/1988 | Brown | |
| 4,823,974 | A | 4/1989 | Crosser | |
| 4,981,022 | A | 1/1991 | Snyder | |
| 4,993,237 | A | 2/1991 | Bond | |
| 5,009,083 | A | 4/1991 | Spinos | |
| D317,543 | S | 6/1991 | Small | |
| D318,009 | S | 7/1991 | Litton | |
| 5,031,831 | A | 7/1991 | Williams | |
| 5,129,238 | A | 7/1992 | Schwartz et al. | |
| D339,955 | S | 10/1993 | Katz | |
| 5,456,090 | A | 10/1995 | McCoy | |
| 5,467,877 | A | 11/1995 | Smith | |
| 5,472,274 | A | 12/1995 | Baillie | |
| 5,502,981 | A | 4/1996 | Sullivan | |
| D371,269 | S | 7/1996 | Shattuck et al. | |
| D380,677 | S | 7/1997 | Jorgensen | |
| 5,651,254 | A | 7/1997 | Berry | |
| 5,732,567 | A | 3/1998 | Anderson | |
| D401,697 | S | 11/1998 | Cloonan et al. | |
| D404,647 | S | 1/1999 | Federighi | |
| 5,881,868 | A | 3/1999 | Soyak et al. | |
| 5,897,037 | A | 4/1999 | Mann | |
| D420,253 | S | 2/2000 | Malusek | |
| 6,103,280 | A | 8/2000 | Molzahn et al. | |
| 6,196,017 | B1 | 3/2001 | Chapman | |
| 6,324,864 | B1 | 12/2001 | Stewart et al. | |
| D459,227 | S | 6/2002 | Liebmann, Jr. | |
| 6,494,056 | B1 | 12/2002 | Roth et al. | |
| 6,584,800 | B1 | 7/2003 | Roth et al. | |
| D478,511 | S | 8/2003 | Reynolds | |
| 6,622,516 | B1 | 9/2003 | Horen | |
| 6,658,859 | B2 | 12/2003 | Phelps et al. | |
| 6,751,982 | B2 | 6/2004 | Horen | |
| D499,023 | S | 11/2004 | Amos | |
| 6,889,945 | B2 | 5/2005 | McCall | |
| D511,995 | S | 11/2005 | Pettis, III | |
| 7,069,739 | B2 | 7/2006 | Porter | |
| 7,082,784 | B2 | 8/2006 | Roth et al. | |
| 7,185,782 | B2 | 3/2007 | Vilchez, Jr. et al. | |
| 7,299,936 | B2 | 11/2007 | Singh et al. | |
| D559,870 | S | 1/2008 | Conlon, Jr. et al. | |
| D596,440 | S | 7/2009 | Rothenberg | |
| D596,944 | S | 7/2009 | Mueller et al. | |
| D602,355 | S | 10/2009 | Waaland | |
| 7,614,512 | B2 | 11/2009 | Nader | |
| 7,614,513 | B2 | 11/2009 | Anderson | |
| D621,660 | S | 8/2010 | Smiedt et al. | |
| 7,802,446 | B2 | 9/2010 | Overgaard | |
| 7,810,348 | B2 | 10/2010 | Shewchuk | |
| D631,285 | S | 1/2011 | Smiedt | |
| D632,571 | S | 2/2011 | Blythe | |
| D633,753 | S | 3/2011 | White | |
| D634,158 | S | 3/2011 | Roth et al. | |
| 7,997,099 | B2 | 8/2011 | Roth et al. | |
| 8,042,356 | B2 | 10/2011 | Norris et al. | |
| 8,051,674 | B2 | 11/2011 | Roth et al. | |
| 8,061,158 | B2 | 11/2011 | Roth et al. | |
| 8,066,152 | B2 | 11/2011 | Tetreault et al. | |
| 8,069,860 | B2 | 12/2011 | Soyak et al. | |
| D660,077 | S | 5/2012 | Burns | |
| 8,172,454 | B2 | 5/2012 | Choi | |
| D682,691 | S | 5/2013 | Hewitt et al. | |
| 2002/0005044 | A1 | 1/2002 | Mahajan | |
| 2003/0196448 | A1 | 10/2003 | Roth et al. | |
| 2004/0123620 | A1* | 7/2004 | Porter | F25D 31/007 62/457.3 |
| 2005/0252234 | A1 | 11/2005 | Kim | |
| 2006/0010903 | A1 | 1/2006 | Porter | |
| 2006/0162374 | A1* | 7/2006 | Ganser | A47G 23/04 62/457.4 |
| 2007/0090205 | A1 | 4/2007 | Kunze et al. | |
| 2007/0147469 | A1 | 6/2007 | Harris | |
| 2008/0282907 | A1 | 11/2008 | Begin et al. | |
| 2008/0290062 | A1* | 11/2008 | Luzaich | B65D 39/0076 215/307 |
| 2009/0212071 | A1 | 8/2009 | Tom | |
| 2010/0202244 | A1 | 8/2010 | Choi | |
| 2011/0042418 | A1 | 2/2011 | Lambrecht | |
| 2011/0108506 | A1 | 5/2011 | Lindhorst-Ko | |
| 2011/0114218 | A1 | 5/2011 | Overgaard | |
| 2011/0204093 | A1 | 8/2011 | Lee | |
| 2012/0074172 | A1* | 3/2012 | Federighi | B01F 3/0446 222/190 |
| 2012/0111893 | A1* | 5/2012 | Luebke | B01F 3/0446 222/190 |
| 2012/0266625 | A1 | 10/2012 | Hewitt et al. | |
| 2013/0051174 | A1* | 2/2013 | Tsai | B01F 5/0428 366/163.2 |

FOREIGN PATENT DOCUMENTS

| | | | |
|---|---|---|---|
| CN | 201264748 | Y | 7/2009 |
| DE | 10037433 | A1 | 8/2001 |
| DE | 20303040 | U1 | 4/2004 |
| EP | 1450118 | A2 | 8/2004 |
| EP | 1985951 | A1 | 10/2008 |
| FR | 2736894 | A1 | 1/1997 |
| FR | 2805337 | A1 | 8/2001 |
| GB | 2340591 | A | 2/2000 |
| JP | 2001048244 | A1 | 2/2001 |

(56) References Cited

FOREIGN PATENT DOCUMENTS

OTHER PUBLICATIONS

Extended European Search Report dated Aug. 4, 2016, with regard to European Application No. 1473512.7.
PCT/US2014/010069; International Search Report mailed May 7, 2014.
PCT/US2012/034016 International Search Report mailed Nov. 29, 2012.
Propylene Glycol bases heat-transfer Fluids, The Engineering Toolbox, www.engineeringtoolbox.com Sep. 15, 2010, accessed through archive.org/web Apr. 16, 2014.
Chef Todd English Will Launch the Todd English Collection™ on HSN and HSN.Com on Nov. 7 and 8.
Corkcicle Wine Chiller, kitchenboy , By KitchenBoy (http://kitchenboy.net/blog/author/administrator/), Aug. 17, 2012.
Wine Sceptre, youtube, 2 Mar. 18, 2010, YouTube, http://www.youtube.com/watch?v=Qt58q8jdp08.
CB Peoples & AE Yelton, Milk Can, 3 of 3, Jun. 25, 1912, USPTO Washington DC.
LG Royal Jr, Rubber Stopper, 3 of 3, Jul. 28, 1950 USPTO Washington DC.
PCT/US2013/044958; International Search Report mailed Sep. 2, 2013.
Matsuri Sake Set by Roost, Oprah.com.

* cited by examiner

APPARATUS FOR REGULATING A TEMPERATURE OF A FLUID IN A CONTAINER, AND AERATING AND DISPENSING THE FLUID

BACKGROUND OF THE INVENTION

Field of the Disclosure

The present invention relates in general to regulating the temperature of a fluid in a container and, in particular, to an apparatus for regulating the temperature of wine in a bottle, and aerating the wine when it is dispensed through the apparatus.

Background Art

The temperature at which wine is served is important to appreciate its special qualities and flavors. There are various tables of authorities that show the ideal temperature ranges for each type of wine or vintage. The temperature ranges vary greatly according to the type of wine. The widest range exists between the desired temperatures associated with red wines versus that of white wines.

There are several factors that make it challenging to maintain the ideal temperature that allows a wine to reveal all of its qualities. One factor concerns the conditions in which the bottles are kept after they are opened. This can lead to a wine temperature that is either too high or too low after the bottle is selected, opened and served. It is difficult to keep wine bottles within satisfactory temperature conditions, as they will more often than not become too warm when left on a table at room temperature, or become too cold if put on ice. Once removed from a proper cooling environment, keeping a chilled wine at a temperature below ambient temperature is particularly difficult.

There also is some risk of the wine losing its flavors and taste by bringing about a decrease in temperature that occurs too quickly. For example, use of a wine ice bucket or freezer may cause this destructive effect on the qualities of wine. In some businesses, such as restaurants and catering, this process needs to be done quickly and cannot be avoided. It is rarely possible for some wine servers to ask a customer to wait to taste the vintage chosen on a wine list. It is also undesirable to risk being discredited by serving a wine that is at the wrong temperature. It is therefore desirable to facilitate bringing and maintaining wine at an ideal temperature to savor it without necessarily affecting its qualities.

Various solutions have been proposed to maintain the desired wine temperature in conditions that reduce risk to affecting its taste. Again, wine ice buckets are a common choice for this proposition. Other devices may be inserted into a bottle of wine and incorporate pour-through apertures and/or aeration such that the devices are not removed from the bottle until it is empty. Moreover, conventional pour-through devices enable ventilation of the beverage which increases its temperature and affects its taste. Thus, improvements in regulating the temperature of wine and aerating wine would be desirable.

SUMMARY OF INVENTION

Embodiments of an apparatus for regulating a temperature of a fluid inside a container, aerating and dispensing the fluid from the container are disclosed. The apparatus may comprise a body adapted to contact the fluid inside the container. The body may include an axis, a cavity adjacent a distal end, and a second fluid located and sealed inside the cavity. The second fluid can have a freezing point of about 10° C. or less. An aerator may be mounted to the body and has a fluid inlet, a fluid outlet, and an air inlet and an air outlet. The aerator can have a channel extending between the fluid inlet to the fluid outlet and out of the container. The air inlet can be configured to flow air to the air outlet and into the container. A passage may be configured to flow at least a portion of the air from the air inlet into the channel to aerate the fluid. An external seal may be included on the apparatus and configured to engage an opening in the container.

In another embodiment, an apparatus for regulating a temperature of a fluid in a bottle may include a body having an axis, and a cavity inside the body. The body may be elongated in an axial direction such that an exterior of the body is generally tapered axially for a substantially entire axial length thereof. A fluid may be sealed in the cavity and having a freezing point below about 10° C., such as about 0° C. or less. An assembly may be mounted to the body. An exterior of the assembly can be adapted to seal the bottle of fluid. An interior of the assembly can be adapted to dispense and aerate fluid therethrough.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
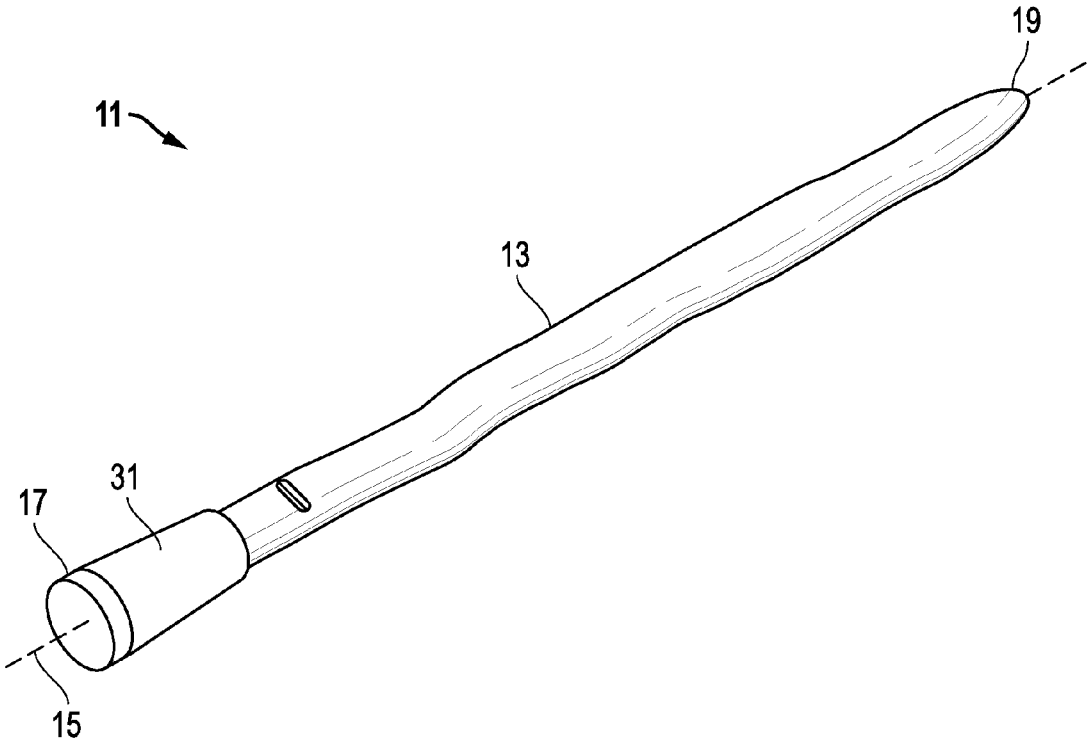
FIGS. 1 and 2 are isometric and axial sectional views, respectively, of an embodiment of an apparatus.

Embodiments of an apparatus for maintaining the temperature of a fluid and dispensing the fluid from a container are disclosed. As shown in FIG. 1, the apparatus 11 may comprise a body 13 having a longitudinal axis 15, a proximal end 17, and a distal end 19. In some examples, the body 13 may be formed from a metallic material such as stainless steel, aluminum, copper, etc., which may be opaque. In other embodiments, a plastic material such as a translucent or transparent ethylene-based copolymer, polymeric blends of ethylene-methacrylic acid copolymers and polyethylene, etc., may be used for the body.

Figure 2:
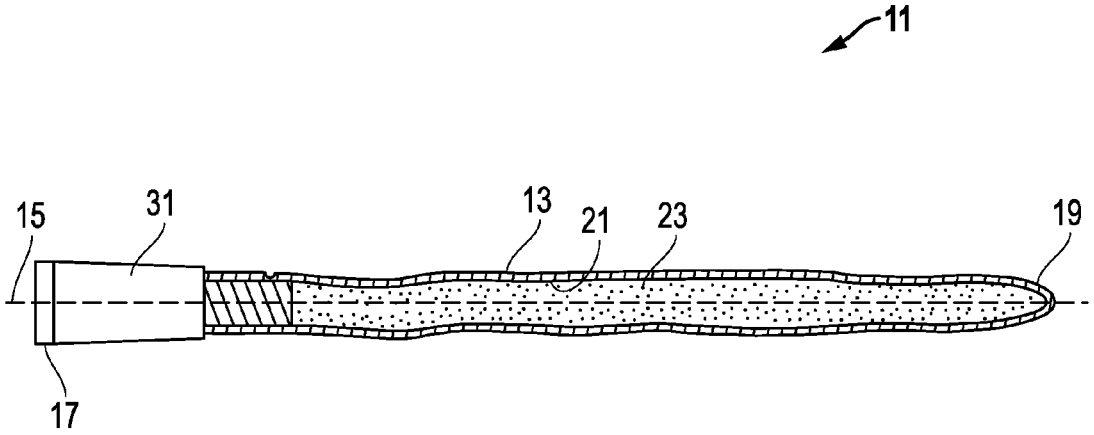
Figure 3:
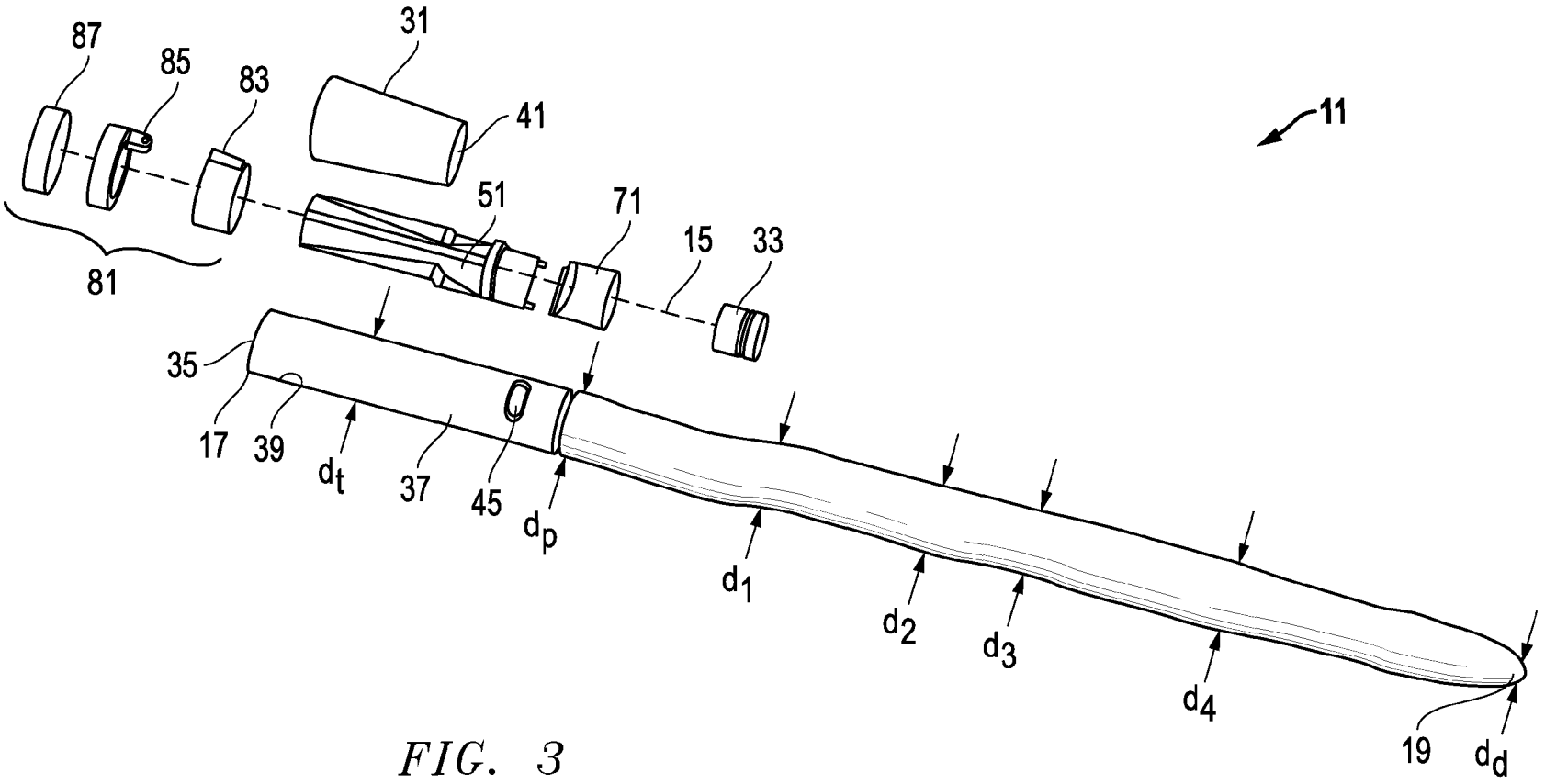
FIG. 3 is an exploded isometric view of an embodiment of the apparatus.

A cavity 21 (FIG. 2) is located inside the body 13. At manufacture, the cavity 21 is originally open on the proximal end 17, closed on the distal end 19, and has an elongated, generally tapered shape along an axial length of the body 13. A fluid 23 is located in the cavity 21 and may be sealed in the cavity with a plug 33 (FIG. 3). The fluid 23 may have a freezing point of about 10° C. or less, such as about 0° C. or less. For example, the freezing point of the fluid 23 may be in a range of −1° C. to −30° C. Embodiments of the fluid 23 may comprise a liquid or gel having a high potential heat value and a high specific heat capacity. The fluid has good water retention properties and is reusable. The fluid is non-toxic, non-polluting and a non-irritant to human contact. The fluid may comprise water and additives that cause the water to remain a thick gel throughout use, instead of transitioning between a solid and a free-flowing liquid like ordinary water. Such a gel may be formed from non-toxic materials that will not liquefy, and therefore will not spill easily or cause contamination if the container breaks. For example, the gel may be made by adding hydroxyethyl cellulose (e.g., cellusize) or vinyl-coated silica gel to water.

When apparatus 11 is chilled or frozen, fluid 23 helps maintain or regulate a temperature of a liquid, such as wine 25 in a bottle 27. See, e.g., FIG. 4. In some embodiments a seal or seal assembly, such as a stopper 31 (e.g., a gasket, ring, plunger, cork, etc.), may be mounted to the proximal end 17 of the body 13. Stopper 31 may be adapted to slidingly and temporarily engage and seal the bottle 27 of wine 25. However, embodiments of stopper 31 are retained by bottle 27 in a manner sufficient to prevent the accidental and/or premature removal of apparatus 11 from bottle 27. As will be described elsewhere herein, this design also permits fluid to flow from the bottle through the apparatus with the body still located inside of the bottle in contact with the wine. The stopper may comprise natural or synthetic materials such as those known in the art. For example, a synthetic cork may be formed from a high quality, food grade thermoplastic elastomer, a wood material bonded by a bond material or resin, etc. The seal or stopper also provides structural support during the freezing and thawing cycles experienced during operational use, which better accommodates for expansion and contraction of materials to help prevent layered or laminated designs from failing.

In some embodiments, at least some of the components of apparatus 11 may be joined by conventional techniques, such as spin or ultrasonic welding, such that they are permanently joined to each other. Adhesives also may be used to join the components. Some embodiments of the body may be sealed to retain the fluid, or a closure of the cavity may be bonded, crimped, welded, etc., to permanently enclose the fluid. The seal may be attached to the body to provide a sliding interface surface for temporarily closing a container of fluid.

Embodiments of the body 13 may have only one cavity 21, only one fluid 23, and be non-cylindrical. The body 13 may have an opening 35 (FIG. 4) on the proximal end 17. Both the exterior surface of the body 13 and the interior surface of the cavity 21 may be generally conically tapered along their substantially entire axial lengths. Tapering of the cavity 21 may facilitate progressive freezing of the fluid from the distal end 19 toward the proximal end 17, and thereby the desired expansion of the fluid 23 as the fluid freezes solid. Such progressive freezing helps maintain the integrity of the body, even after numerous freezing/thawing cycles and uses, without leakage or rupture of the body. In some embodiments, the volume of fluid 23 contained within cavity 21 is sufficient so as to not be visible from an exterior of body 13 when held or stored upright with the stopper 31 at the top.

Figure 4:
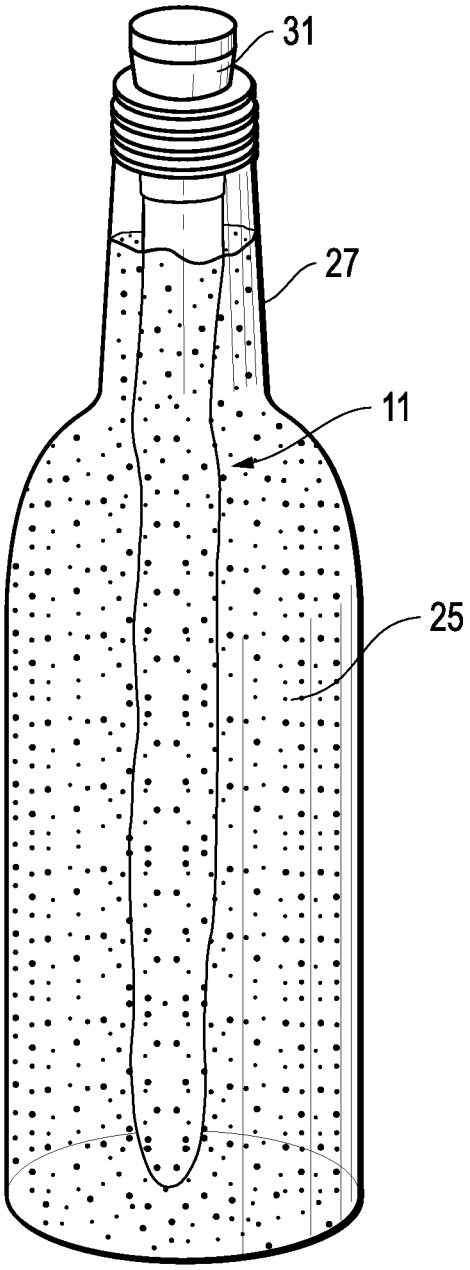
FIG. 4 is an isometric view of an embodiment of the apparatus in operation.

As shown in FIG. 4, the proximal end 17 of the body 13 may comprise a tube 37 extending axially from the body 13. The tube 37 may have a tube diameter ($d_t$) that is smaller than a proximal diameter ($d_p$) of the body. The stopper 31 may be mounted to the tube 37 via a through-hole 41 for receiving the tube 37. The through hole 41 is complementary in shape to the tube 37.

In some embodiments, the body 13 is shaped in the form of an icicle, and may vary in axial sectional shape along a substantially entire axial length thereof. The body 13 may have an exterior surface that undulates axially, radially and/or circumferentially. As a result, some examples of the undulated body have an axial cross-sectional shape that varies continuously to the distal end 19. Such a configuration mimics naturally formed icicles. Such designs also increase the surface area of the body, thereby increasing its wine temperature maintenance performance. In other versions, the body has only a slight overall taper (e.g., like a carrot), rather than the icicle form. In still other versions, the body may be tapered with facets to appear crystalline in form, or may be cylindrical in shape.

In other examples, the body 13 may be provided with a proximal diameter ($d_p$) that defines a maximum diameter of the body, a distal diameter at the distal end ($d_d$) that defines a minimum diameter of the body, a first intermediate diameter ($d_1$) located between $d_p$ and $d_d$ that is smaller than $d_p$, and a second intermediate diameter ($d_2$) located between $d_1$ and $d_d$ that is larger than $d_1$. This pattern may be repeated. For example, a third intermediate diameter ($d_3$) may be smaller than $d_2$ but located between $d_2$ and $d_d$. A fourth intermediate diameter ($d_4$) may be larger than $d_3$, but located between $d_3$ and $d_d$. The interior surface of the cavity may mimic the profile or contour of the exterior of the body, such that the interior and exterior surfaces of the body are complementary in shape. For example, the body may have a maximum outer diameter of about 15 mm to about 18 mm, the body may have a wall thickness of about 0.5 to about 1 mm, and the apparatus may have an overall length of about 270 mm to about 300 mm These dimensions may be varied to accommodate containers or bottles having different sizes.

Figure 5:
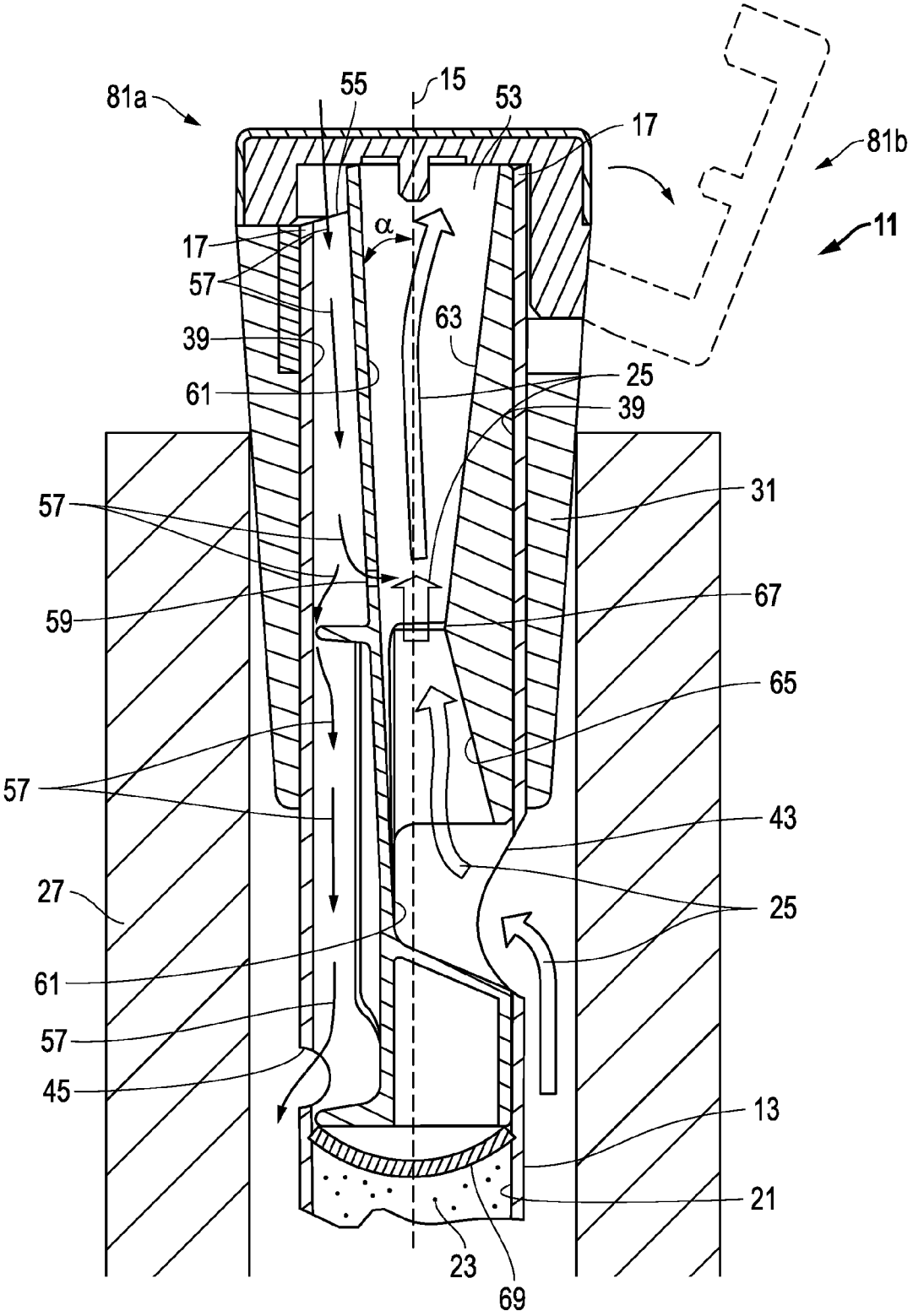
FIG. 5 is an enlarged sectional side view of an upper portion of an embodiment of the apparatus with the cap in a closed position.

FIGS. 3 and 5 illustrate embodiments of the apparatus 11 that further comprise a bore 39 in the tube 37 adjacent the proximal end 17. In FIG. 5, the proximal end 17 is formed at an angle (e.g., frustocylindrical) with respect to axis 15. A fluid inlet 43 may be formed through the body 13 to the bore 39. An air outlet 45 also may be formed through the body 13 to the bore 39.

Embodiments of an aerator 51 may be located in the bore 39 of the body 13. The aerator 51 may separate the fluid inlet 43 from the air outlet 45. The aerator 51 may have a channel 53 in communication with the fluid inlet 43 through which the fluid 25 is adapted to flow out of the aerator 51. The aerator 51 also may include an air inlet 55 between the bore 39 and the aerator 51 through which air 57 is adapted to flow to the air outlet 45 and into the container 27. A hole 59 may be formed in the channel 53 through which air also may flow from the air inlet 55 into the channel 53 to aerate the fluid 25.

Figure 6A:
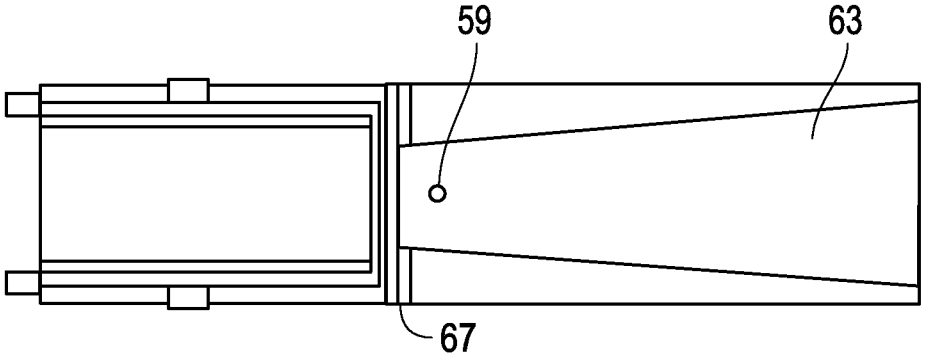
FIGS. 6A, 6B and 6C are top, side and bottom views, respectively of an embodiment of an aerator.
Figure 6B:
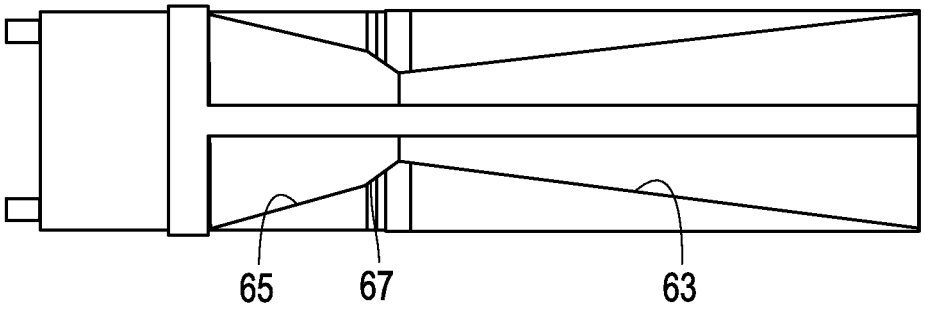
Figure 6C:
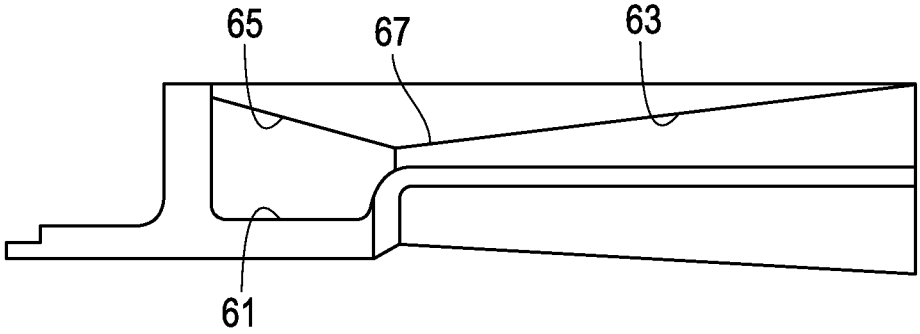
Figure 7C:
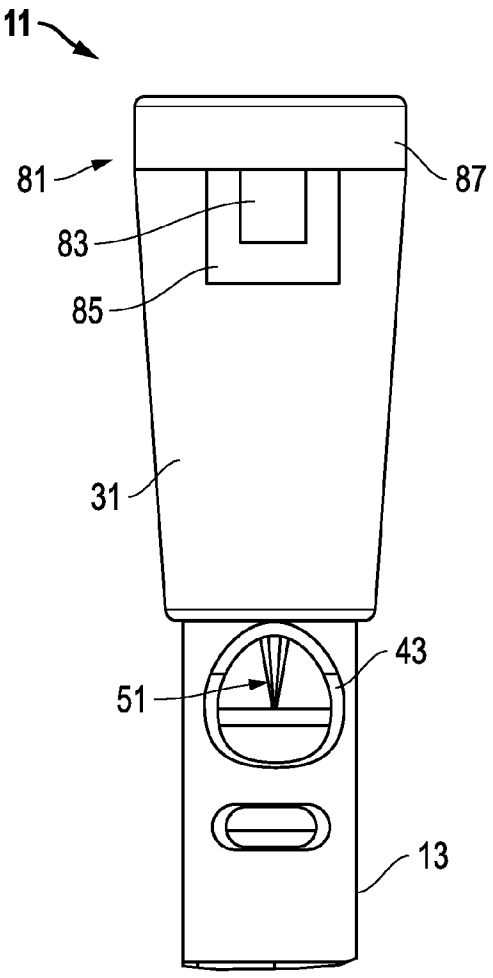
FIGS. 7A, 7B and 7C are front, side and rear views, respectively of an upper portion of an embodiment of the apparatus.
Figure 7B:
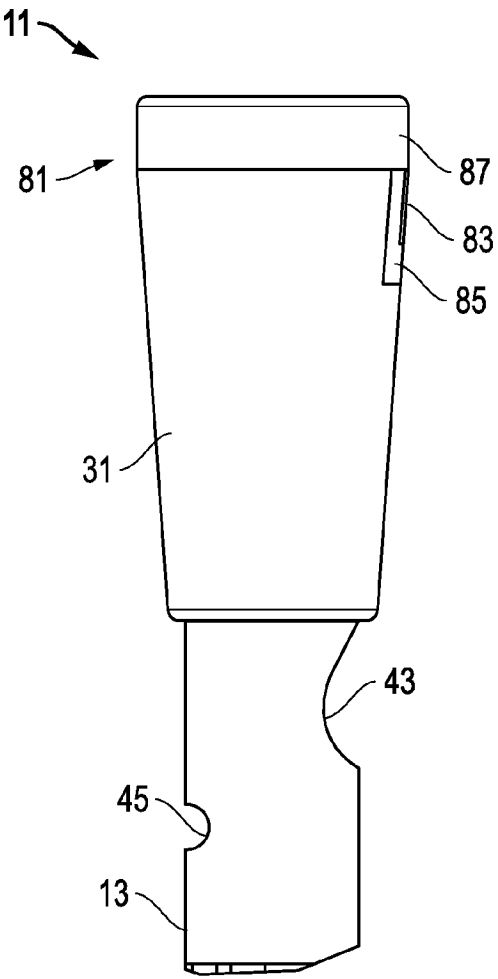
Figure 7A:
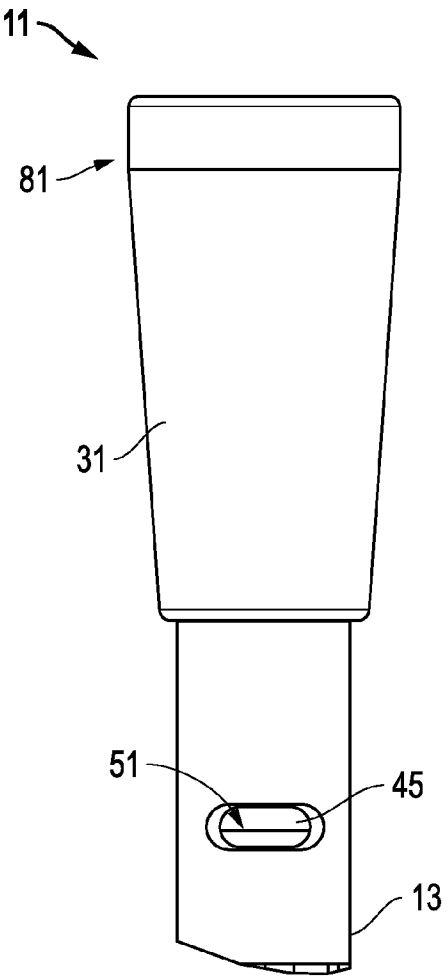
Figure 8:
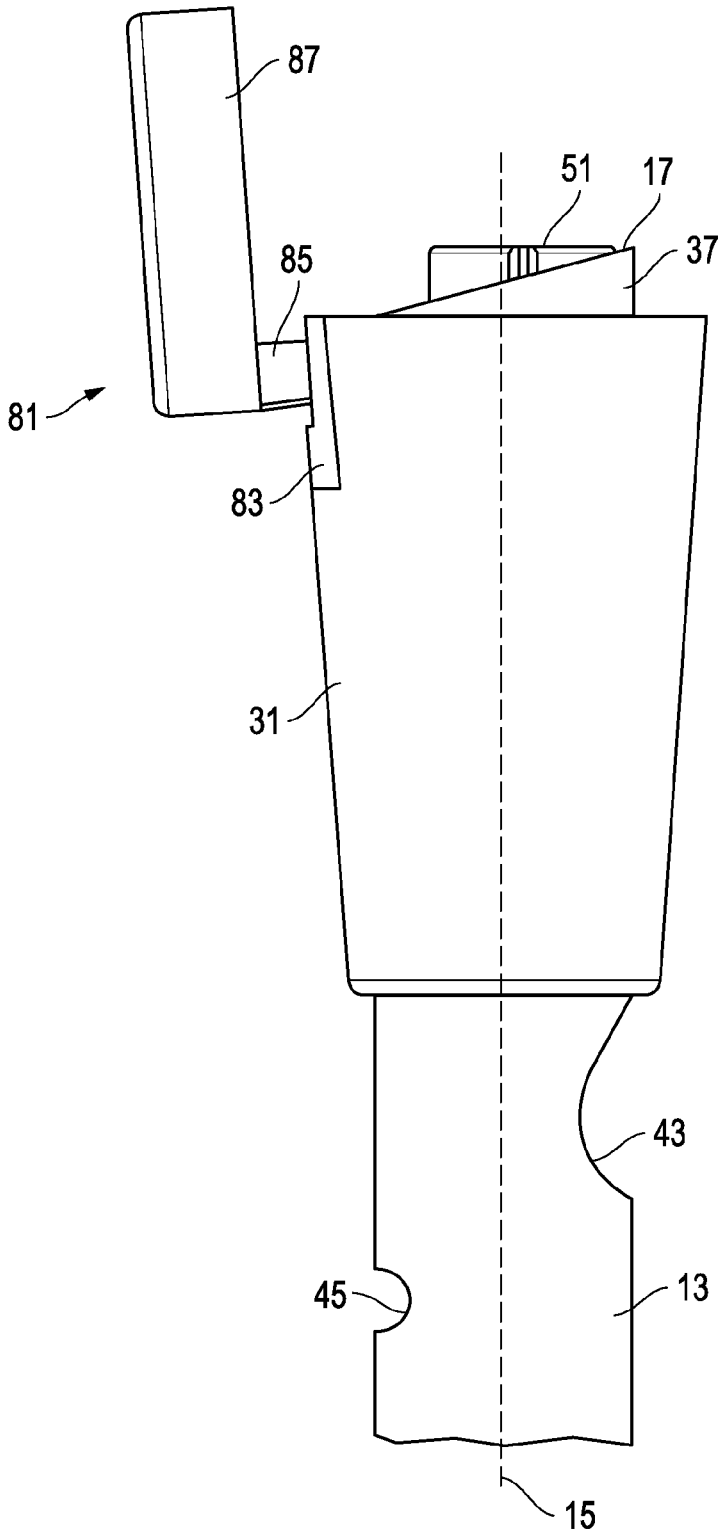
FIG. 8 is an enlarged side view of an upper portion of an embodiment of the apparatus with the cap in an open position.

Embodiments of the aerator 51 may be asymmetrical in a first axial profile (FIGS. 5 and 6C), and symmetrical in a second axial profile (FIGS. 6A or 6B) that is transverse to the first axial profile. As shown in FIG. 5, one side of the channel 53 may be configured in a flat configuration 61, and an opposite side of the channel 53 may be tapered in two directions 63, 65. The flat side 61 of the channel also may be inclined (e.g., at an angle $\alpha$) relative to the axis 15, such that a radial distance from the bore 39 to the flat side 61 of the channel 53 increases from a proximal end 17 of the aerator 51 to a distal end (i.e., adjacent fluid inlet 43) of the aerator 51.

In some embodiments, the aerator 51 comprises a venturi. The venturi may comprise a converging section 65 from about the fluid inlet 43 to a throat 67, and a diverging section 63 from the throat 67 past the hole 59 to a proximal end 17 of the aerator 51. In some versions, the aerator 51 has a distal end 69 (FIG. 5) that eliminates the need for plug 33 such that it permanently seals the second fluid 23 inside the cavity 21. In other versions, an additional spacer component 71 (FIG. 3) may be affixed between the aerator 51 and the plug 33. In addition, the aerator 51 may be provided with an axial length that extends from about the cavity 21 to about the proximal end 17 of the body 13.

Embodiments of the air outlet 45 may be axially closer to the cavity 21 than the fluid inlet 43. Moreover, the air outlet 45 may be smaller than the fluid inlet 43. In still other examples, the air outlet 45 is substantially elliptical in shape and has a major axis transverse to the axis 15, and the fluid inlet 43 is substantially circular in shape. As shown in FIG. 5, the air outlet 45 may be located in the body 13 circumferentially opposite to the fluid inlet 43.

Embodiments of the apparatus 11 may further comprise a cap or cap assembly 81 located adjacent the proximal end 17 of the body 13. The cap 81 may be movable and have a closed position (FIG. 5, solid lines 81*a*) for closing the proximal end 17 of the body 13. In addition, the cap 81 may have an open position (FIG. 5, phantom lines 81*b*) to permit fluid 25 to be dispensed from the container 27 through the aerator 51.

In some versions, the cap 81 is hinged to the body 13 and includes retention features for selectively maintaining the cap 81 in the closed and open positions. The cap 81 and the external seal 31 may have complementary external profiles that are generally frustoconical in shape. Alternatively, the cap 81 may be is substantially cylindrical. Embodiments of the cap 81 may include a cap ring 83 mounted to the body 13, and a cap top 85 that is movable relative to the cap ring 83. The cap may further include a cover 87 for the cap top 85.

In operation, apparatus 11 may be chilled or frozen by placing it in a freezer. When a user wishes to maintain or regulate the temperature of a fluid 25 in a container 27, the apparatus 11 may be removed from the freezer and placed in the container 27 through an opening in the container 27 such that body 13 is in contact with the fluid 25 in the container 27. For example, as shown in FIG. 4, the apparatus 11 may be inserted into a bottle 27 of wine 25 to help regulate or maintain the wine 25 at a proper serving temperature for a longer period of time. Any of the embodiments described herein may be used in a similar manner. The apparatus 11 forms a sliding, temporary seal on the bottle 27. When wine 25 is poured, the apparatus 11 remains securely sealed in the container 27, and the wine 25 is aerated by aerator 51 as described herein.

Figure 9:
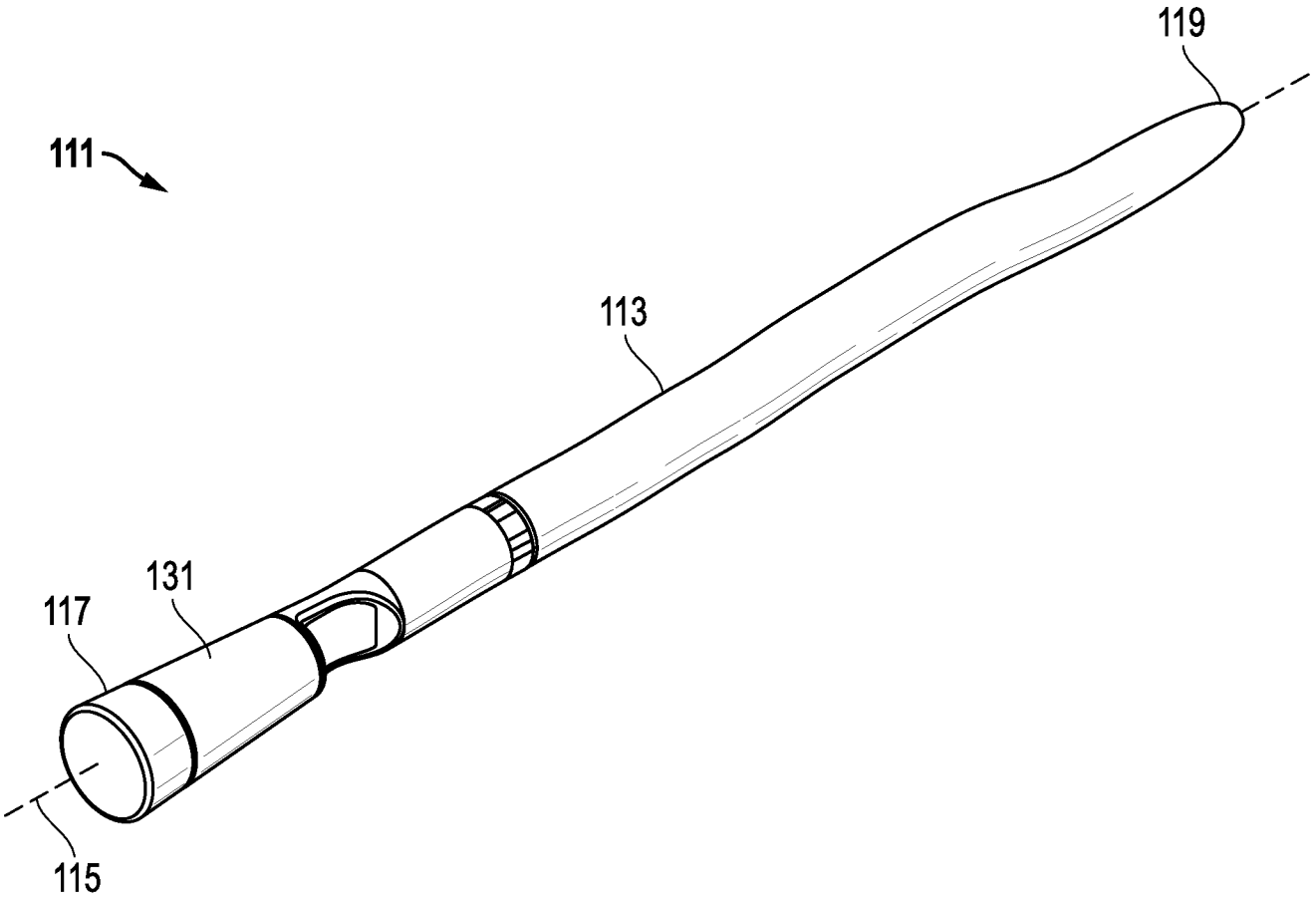
FIG. 9 is an isometric view of another embodiment of an apparatus.

Referring now to FIGS. 9-12, another embodiment of an apparatus for maintaining the temperature of a fluid, aerating and dispensing the fluid from a container is disclosed. As shown in FIG. 9, the apparatus 111 may comprise a body 113 having a longitudinal axis 115, a proximal end 117, and a distal end 119. In some examples, the body 113 may be formed as described elsewhere herein, including an internal cavity 121 (FIG. 11) containing a fluid 123 with a freezing point at or below that of water, as described herein. In some embodiments a seal or seal assembly, such as a stopper 131 (FIG. 9), may be mounted to the proximal end 117 of the body 113. Stopper 131 permits fluid to flow from a bottle 127 (FIG. 11) through the apparatus 111 with the body 113 still located inside of the bottle 127 in contact with a second fluid 125.

Figure 10:
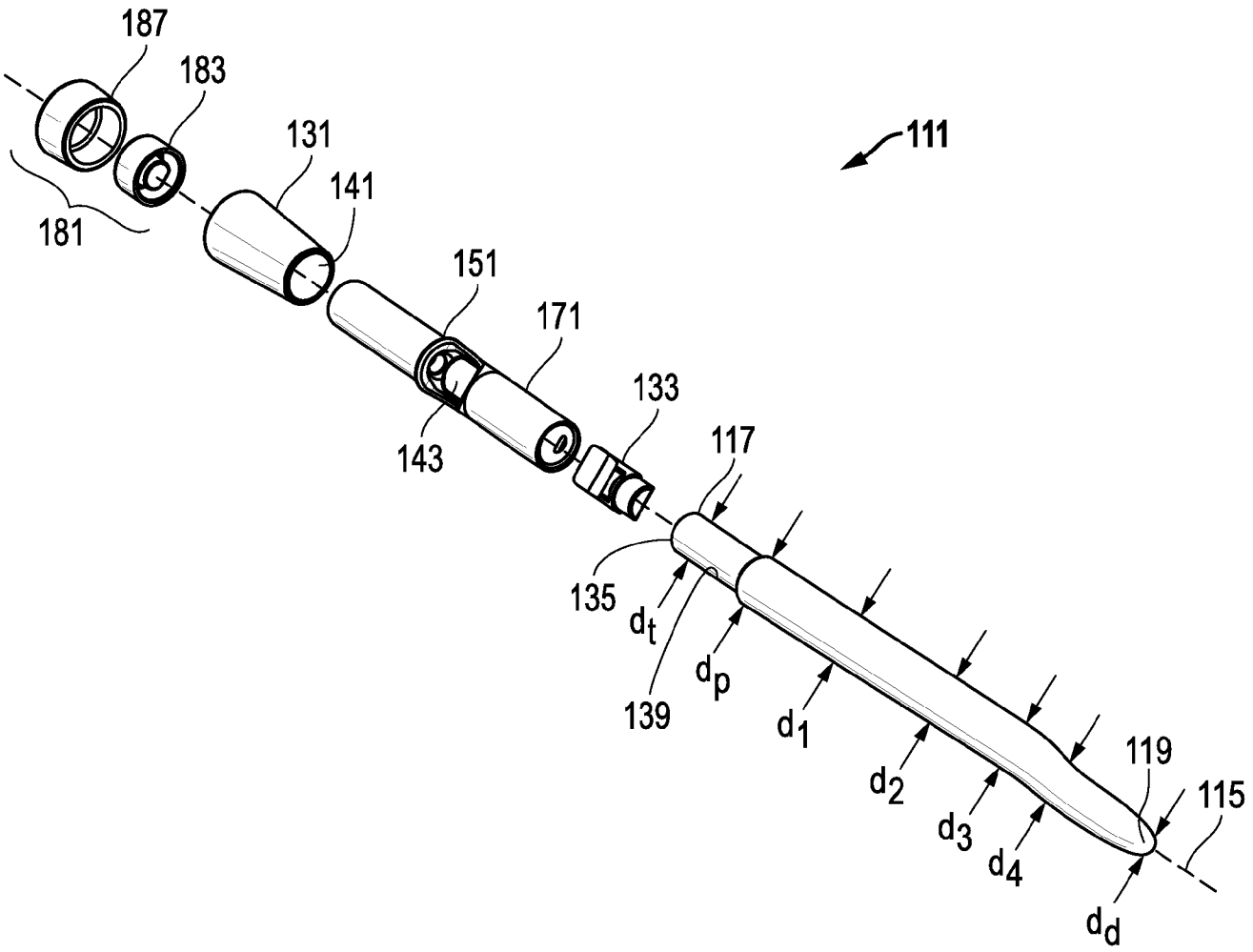
FIG. 10 is an exploded isometric view of an embodiment of the apparatus of FIG. 9, and shown with a cap.

As shown in FIG. 10, embodiments of the body 113 may have an opening 135 on the proximal end 117. The proximal end 117 of the body 113 may comprise a tube 137 extending axially from the body 113. The tube 137 may have a tube diameter ($d_t$) that is smaller than a proximal diameter ($d_p$) of the body. The stopper 131 may be mounted to the tube 137 via a through-hole 141 for receiving the tube 137.

As described herein, the body 113 may be shaped in various forms, such as an icicle, and may vary in axial sectional shape. In an example, the body 113 may be provided with a proximal diameter ($d_p$) that defines a maximum diameter of the body, a distal diameter at the distal end ($d_d$) that defines a minimum diameter of the body, a first intermediate diameter ($d_1$) located between $d_p$ and $d_d$ that is smaller than $d_p$, and a second intermediate diameter ($d_2$) located between $d_1$ and $d_d$ that is larger than $d_1$. This pattern may be repeated. For example, a third intermediate diameter ($d_3$) may be smaller than $d_2$ but located between $d_2$ and $d_d$. A fourth intermediate diameter ($d_4$) may be larger than $d_3$, but located between $d_3$ and $d_d$. The interior surface of the cavity 121 (FIG. 11) may mimic the profile or contour of the exterior of the body 113, such that the interior and exterior surfaces of the body 113 are complementary in shape.

Figure 11:
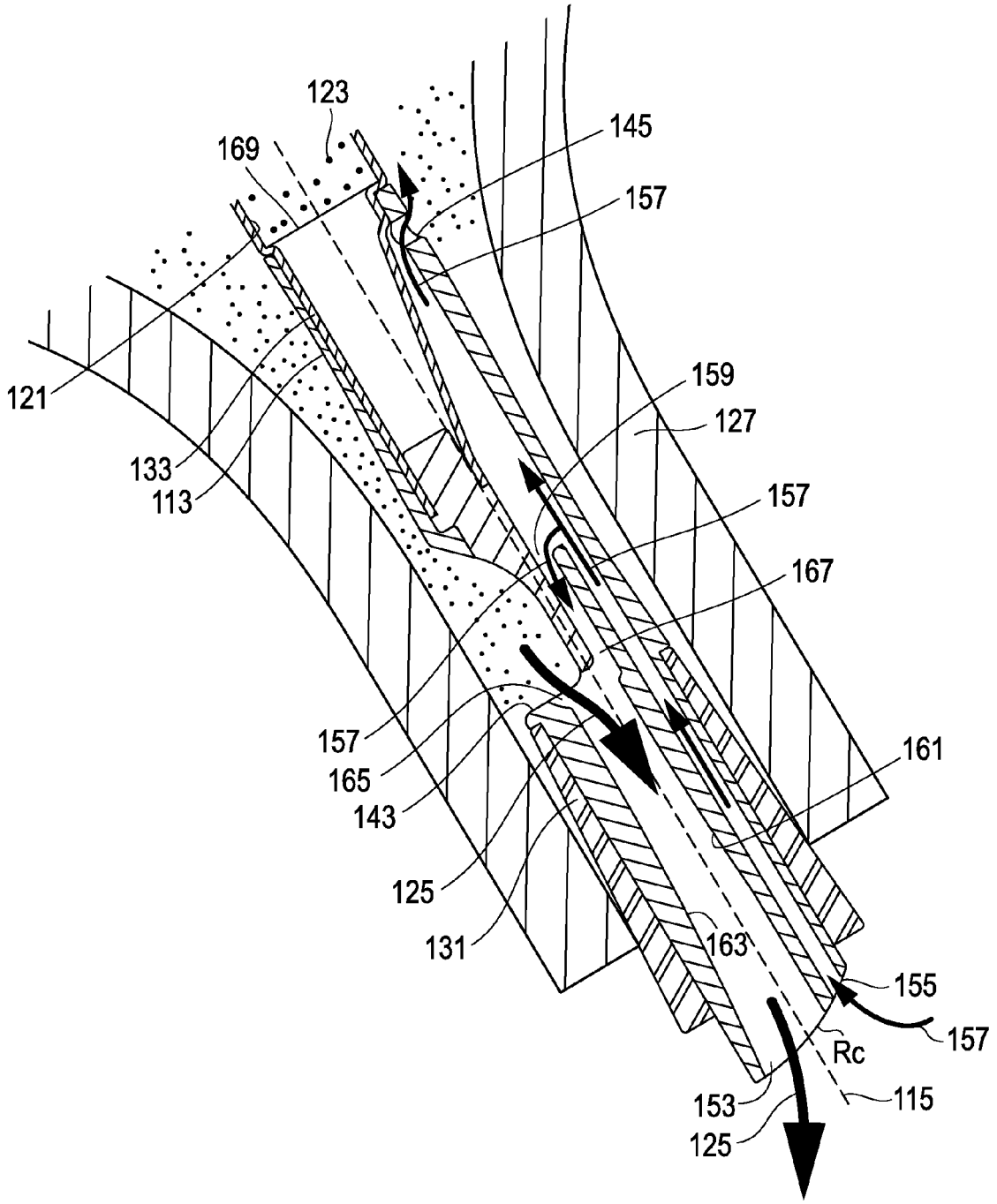
FIG. 11 is a sectional side views of an embodiment of the apparatus of FIG. 9, shown with and without a cap, respectively.

FIGS. 10 and 11 illustrate embodiments of the apparatus 111 that further comprise an aerator 151. The aerator 151 includes a plug 133 that inserts into a bore 139 in the tube 137 adjacent the proximal end 117. A fluid inlet 143 may be formed in the aerator 151. The aerator 151 may further include an air outlet 145 formed through an outer wall thereof and in fluid communications with fluid inlet 143 through passage 159. Air flow 157 flows from air inlet 155 to air outlet 145 and passage 159. Embodiments of the aerator 151 may separate the fluid inlet 143 from the air outlet 145. The aerator 151 may have a fluid channel 153 in communication with the fluid inlet 143 through which the fluid 125 is adapted to flow out of the aerator 151. The aerator 151 also may include an air inlet 155 through which air 157 is adapted to flow to passage 159, as well as the air outlet 145 and into the container 127. A sort of 'tongue' 156 extends through aerator 151 between fluid channel 153 and air inlet 155. The passage 159 may be formed to the fluid channel 153 through which air also may flow from the air inlet 155 into the fluid channel 153 to aerate the fluid 125 as it dispenses from apparatus 111.

Figure 12A:
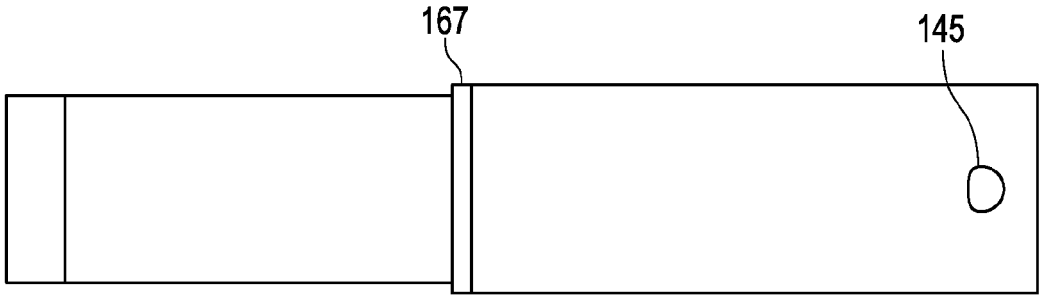
FIGS. 12A, 12B and 12C are top, side and bottom views, respectively of an embodiment of an aerator.
Figure 12B:
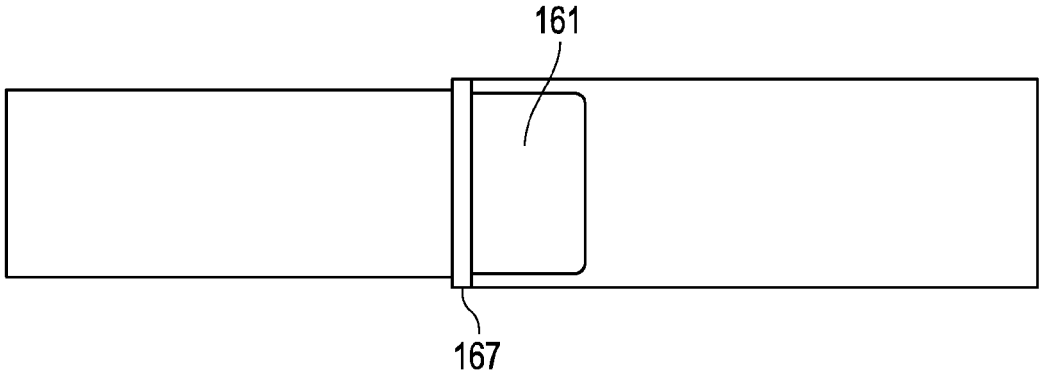

FIGS. 12A and 12B depict embodiments of the aerator 151 that may be symmetrical in a first axial profile, and asymmetrical in a second axial profile (FIG. 12C) that is transverse to the first axial profile. As shown in FIG. 11, the interior surfaces or sides 161, 163 of the fluid channel 153 may be flat, tapered or a combination thereof. A radial distance between sides 161, 163 may increase toward the outer end of fluid channel 153. The aerator 151 may terminate with a rounded outer end (e.g., an arc) having a defined radius of curvature, R.

In some embodiments, the aerator 151 may comprise a venturi. The venturi may comprise a converging section 165 (FIG. 11) from about the fluid inlet 143 to about a throat 167, and a diverging section beyond throat 167 past walls 161, 163 to the end of the aerator 151. In some versions, the plug 133 has an end 169 that permanently seals the fluid 123 inside the cavity 121. In other versions, the plug 133 is axially movable or adjustable (e.g., up to about 0.100 inches) along axis 115 to adjust a rate of aeration of the wine 125. Thus, the plug 133 can form a portion of the profile and the venturi within the aerator 151.

Figure 12C:
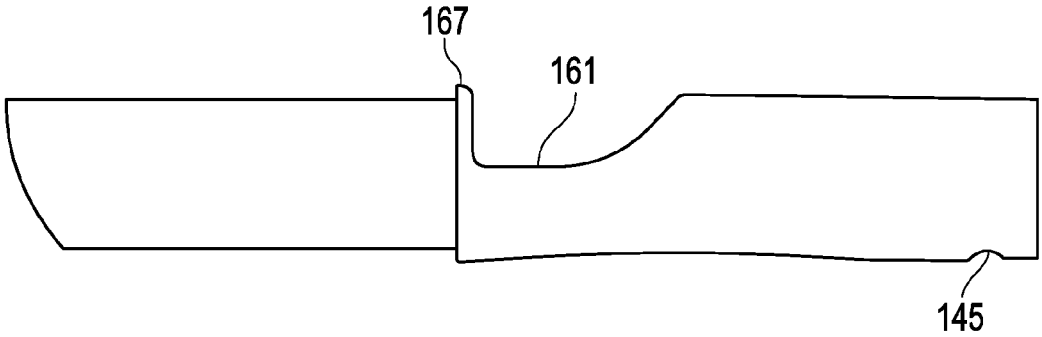

Embodiments of the air outlet 145 may be axially closer to the cavity 121 than the fluid inlet 143. Moreover, the air outlet 145 may be smaller than the fluid inlet 143. As shown in FIG. 12C, the air outlet 145 may be located circumferentially opposite to the fluid inlet 143.

Embodiments of the apparatus 111 may further comprise a cap or cap assembly 181 (FIG. 10) located adjacent the end of the apparatus 111. The cap 181 may comprise a cap assembly 183, 187 that can be installed to close the aerator 151 to a closed position, and removed to provide the aerator 151 with an open position to permit fluid to be dispensed from a container through the aerator 151.

In operation, apparatus 111 may be chilled or frozen by placing it in a refrigerator or freezer. When a user wishes to maintain or regulate the temperature of a fluid 125 in a container 127, the apparatus 111 may be removed from the refrigerator or freezer and placed in the container 127 through an opening in the container 127. The body 113 may be in direct contact with the fluid 125 in the container 127. For example, as shown in FIG. 11, the apparatus 111 may be inserted into a bottle of wine to help regulate or maintain the wine at a proper serving temperature for a longer period of time. Any of the embodiments described herein may be used in a similar manner. The apparatus 111 forms a sliding, temporary seal on the bottle. When wine is poured, the apparatus 111 remains securely sealed in the container 127, and the fluid 125 is aerated by aerator 151 as described herein.

Aspects and features of the various embodiments disclosed herein may be combined, depending on the application. Other applications include uses that do not involve beverages, such as commercial or laboratory cooling or temperature regulation of fluids in containers, wherein the stopper may not necessarily be required to slidingly engage and seal the opening of the container. For example, some containers have top openings that are much larger in diameter than the diameter of the stopper. The numerous features, elements and materials described for the various embodiments disclosed herein may be used in the other embodiments as well.

In still other embodiments, an apparatus for regulating a temperature of a fluid inside a container, and dispensing the fluid from the container may be provided. The apparatus may comprise a body adapted to contact the fluid inside the container. The body may include an axis, a cavity adjacent a distal end, a bore adjacent a proximal end, a fluid inlet formed through the body to the bore, an air outlet formed through the body to the bore, and an external seal adapted to engage an opening in the container. A second fluid may be located and sealed inside the cavity. The second fluid may have a freezing point of about 10° C. or less. An aerator may be positioned in the bore of the body separating the fluid inlet from the air outlet. The aerator may include a channel in communication with the fluid inlet through which the fluid is adapted to flow out of the aerator, an air inlet between the bore and the aerator through which air is adapted to flow to the air outlet and into the container, and a hole in the channel through which air also is adapted to flow from the air inlet into the channel to aerate the fluid. The aerator may include an asymmetrical first axial profile, and a symmetrical second axial profile that is transverse to the first axial profile. In some embodiments, one side of the channel may be flat, and an opposite side of the channel may be tapered in two directions. The flat side of the channel also may be inclined relative to the axis, such that a radial distance from the bore to the flat side of the channel increases from a proximal end of the aerator to a distal end of the aerator.

Embodiments of the aerator may comprise a venturi. The venturi may comprise a converging section from about the fluid inlet to a throat, and a diverging section from the throat past the hole to a proximal end of the aerator. The aerator may have a distal end that permanently seals the second fluid inside the cavity. The aerator may have an axial length that extends from about the cavity to about the proximal end of the body.

Embodiments of the air outlet may be axially closer to the cavity than the fluid inlet. The air outlet may be smaller than the fluid inlet. The air outlet may be substantially elliptical in shape and have a major axis transverse to the axis. The fluid inlet may be substantially circular in shape. The air outlet may be located in the body circumferentially opposite to the fluid inlet.

In some versions, the apparatus may further comprise a cap located adjacent the proximal end of the body. The cap may be movable and may have a closed position for closing the proximal end of the body. The cap may have an open position for permitting fluid to dispense from the container through the aerator. The cap may be hinged to the body and may include retention features for selectively maintaining the cap in the closed and open positions. The cap and the external seal may have complementary external profiles that are generally frustoconical in shape. The cap may include a cap ring mounted to the body, and a cap top that is movable relative to the cap ring.

Embodiments of the body may be formed from a metallic material. The body may be tapered along a substantially entire axial length thereof. The external seal may be adapted to slidingly and temporarily engage the opening in the container. The freezing point of the second fluid may be in a range of about −1° C. to about −30° C.

The body may vary in axial sectional shape, such that an exterior surface of the body undulates, and the cavity is tapered along a substantially entire axial length thereof. The body may have a proximal diameter ($d_p$) at the proximal end, a distal diameter ($d_d$) at the distal end that defines a minimum diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$. Embodiments of the proximal end of the body may comprise a cylindrical tube having a tube diameter that is smaller than a diameter of the body.

In still other embodiments, an apparatus for regulating a temperature of a fluid in a bottle may comprise a body having an axis, a proximal end, a distal end, and a cavity inside the body. The body may be elongated in an axial direction such that an exterior of the body is generally tapered axially for a substantially entire axial length thereof. A fluid may be sealed in the cavity and having a freezing point below about 10° C. An assembly may be mounted adjacent the proximal end of the body. An exterior of the assembly may be adapted to seal the bottle of fluid. An interior of the assembly may be adapted to dispense fluid therethrough. The exterior of the assembly may be frustoconically tapered.

Other embodiments of an apparatus for regulating a temperature of a fluid inside a container, and dispensing the fluid from the container, may comprise a body adapted to contact the fluid inside the container. The body may have an axis, a cavity adjacent a distal end, a bore adjacent a proximal end, and an external seal adapted to engage an opening in the container. A second fluid may be located and sealed inside the cavity. The second fluid may have a freezing point of about 10° C. or less. In addition, an aerator may be in the bore of the body through which the fluid is adapted to flow out of the aerator.

Embodiments of the body may have a radial wall thickness at the bore (Rb), and the body has a radial wall thickness at the cavity (Rc) that is less than Rb by at least about 10%, at least about 20%, or at least about 30% (e.g., about 32%). The Rc may vary along the cavity in the axial direction. The cavity may comprise radially wide portions (e.g., bulges) and radially narrow portions (e.g., narrower neck sections that are smaller than the bulges), with respect to the axis. The Rc may be greater in the radially narrow portions and the Rc may be less in the radially narrow portions. In addition, the body may comprise a stainless steel and copper alloy, such as 304 stainless steel, and at least about 5% copper, or no more than about 15% copper (e.g., about 8% to about 10%).

In still other embodiments, the apparatus may comprise one or more of the following items. For example:

Item 1. An apparatus for regulating a temperature of a fluid inside a container, and aerating and dispensing the fluid from the container, the apparatus comprising:

a body adapted to contact the fluid inside the container, the body having an axis, a cavity, and a second fluid located and sealed inside the cavity;

an aerator mounted to the body and having a fluid inlet, a fluid outlet, an air inlet and an air outlet, the aerator having a fluid channel extending between the fluid inlet and the fluid outlet and configured to extend out of the container, the air inlet is configured to flow air to the air outlet and into the container, and a passage is configured to flow at least a portion of the air from the air inlet into the fluid channel to aerate the fluid; and an external seal on the apparatus configured to engage and seal an opening in the container.

Item 2. The apparatus of claim 1, wherein a rate of aeration of the fluid is adjustable.

Item 3. The apparatus of claim 1, wherein sides of the fluid channel are tapered.

Item 4. The apparatus of claim 1, wherein the aerator comprises a plug that seals the second fluid inside the cavity.

Item 5. The apparatus of claim 4, wherein the aerator comprises a venturi, and the plug forms a portion of the venturi.

Item 6. The apparatus of claim 5, wherein the venturi comprises a converging section from about the fluid inlet to a throat, and a diverging section from the throat toward the fluid outlet.

Item 7. The apparatus of claim 1, wherein the aerator has a tongue that separates the fluid channel from the air inlet and air outlet.

Item 8. The apparatus of claim 1, wherein the aerator has an axial length that extends from about the cavity to the fluid outlet.

Item 9. The apparatus of claim 1, wherein the air outlet is axially closer to the cavity than the fluid inlet.

Item 10. The apparatus of claim 1, wherein the air outlet is smaller than the fluid inlet.

Item 11. The apparatus of claim 1, wherein the external seal is on the aerator.

Item 12. The apparatus of claim 1, wherein the air outlet is located circumferentially opposite the fluid inlet.

Item 13. The apparatus of claim 1, further comprising a cap, the cap is configured to mount to the aerator in a closed position to close the fluid outlet and air inlet, and the cap is detachable from the aerator in an open position and configured to permit fluid to dispense from the aerator.

Item 14. The apparatus of claim 13, wherein the cap and the external seal have complementary external profiles that are generally frustoconical in shape.

Item 15. The apparatus of claim 1, wherein the body is formed from a metallic material and the body is tapered along a substantially entire axial length thereof, and the external seal is adapted to slidingly and temporarily engage the opening in the container.

Item 16. The apparatus of claim 1, wherein a freezing point of the second fluid is in a range of about −1° C. to about −30° C.

Item 17. The apparatus of claim 1, wherein the body varies in axial sectional shape, such that an exterior surface of the body undulates, and the cavity is tapered along a substantially entire axial length thereof.

Item 18. The apparatus of claim 1, wherein the body has a proximal diameter ($d_p$) at a proximal end thereof, a distal diameter ($d_d$) at a distal end thereof that defines a minimum diameter of the body, a first intermediate diameter ($d_1$) located axially between the proximal and distal ends that is smaller than $d_p$, and a second intermediate diameter ($d_2$) located axially between $d_1$ and the distal end that is larger than $d_1$.

Item 19. The apparatus of claim 1, wherein the body has a first radial wall thickness (Rb), and the body has a radial wall thickness at the cavity (Rc) that is less than Rb by at least about 10%.

Item 20. The apparatus of claim 19, wherein the Rc varies along the cavity in the axial direction.

Item 21. The apparatus of claim 20, wherein cavity comprises radially wide portions and radially narrow portions, with respect to the axis, and the Rc is greater in the radially narrow portions and the Rc is less in the radially narrow portions.

Item 22. The apparatus of claim 1, wherein the body comprises a stainless steel and copper alloy.

Item 23. The apparatus of claim 1, wherein the body comprises 304 stainless steel, at least about 5% copper, and no more than about 15% copper.

Item 24. An apparatus for regulating a temperature of a fluid in a bottle, comprising:

a body having an axis, a cavity inside the body, the body is elongated in an axial direction such that an exterior of the body is generally tapered axially for a substantially entire axial length thereof;

a fluid sealed in the cavity; and an assembly mounted to the body, an exterior of the assembly is configured to seal the bottle of fluid, and an interior of the assembly is configured to dispense and aerate fluid therethrough.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus for aerating and dispensing fluid from a container, the apparatus comprising:

a body comprising an aerator having a fluid inlet, a fluid outlet, an air inlet and an air outlet, the aerator having a fluid channel extending between the fluid inlet and the fluid outlet and configured to extend out of the container, the air inlet is configured to flow air to the air outlet and into the container, and a passage is configured to flow at least a portion of the air from the air inlet into the fluid channel to aerate the fluid;

an external seal on the body configured to engage and seal an opening in the container;

the body is tapered along a substantially entire axial length thereof; and a cap mounted to the body to cover the fluid outlet and the air inlet, wherein the cap is configured to be releasable detachable and re-attachable to the body.

2. The apparatus of claim 1, wherein the body is adapted to contact the fluid inside the container, the body having an axis, a cavity, and a second fluid located and sealed inside the cavity, and the aerator is mounted to the body.

3. The apparatus of claim 2, wherein the aerator comprises a plug that seals the second fluid inside the cavity.

4. The apparatus of claim 3, wherein the aerator comprises a venturi, and the plug forms a portion of the venturi.

5. The apparatus of claim 2, wherein the aerator has an axial length that extends from about the cavity to the fluid outlet.

6. The apparatus of claim 2, wherein the air outlet is axially closer to the cavity than the fluid inlet, and the air outlet is smaller than the fluid inlet.

7. The apparatus of claim 1, wherein a rate of aeration of the fluid with the aerator is adjustable.

8. An apparatus for regulating a temperature of a fluid inside a container, and aerating and dispensing the fluid from the container, the apparatus comprising:

a body adapted to contact the fluid inside the container, the body having an axis, a cavity, and a second fluid located and sealed inside the cavity;

an aerator mounted to the body and having a fluid inlet, a fluid outlet, an air inlet and an air outlet, the aerator having a fluid channel extending between the fluid inlet and the fluid outlet and configured to extend out of the container, the air inlet is configured to flow air to the air outlet and into the container, a passage is configured to flow at least a portion of the air from the air inlet into the fluid channel to aerate the fluid; and the aerator comprises a plug that seals the second fluid inside the cavity; and an external seal on the apparatus configured to engage and seal an opening in the container.

9. The apparatus of claim 8, wherein a rate of aeration of the fluid is adjustable.

10. The apparatus of claim 8, wherein the aerator comprises a venturi, and the plug forms a portion of the venturi.

11. The apparatus of claim 8, wherein the aerator has an axial length that extends from about the cavity to the fluid outlet.

12. The apparatus of claim 8, wherein the air outlet is axially closer to the cavity than the fluid inlet, and the air outlet is smaller than the fluid inlet.

13. The apparatus of claim 8, further comprising a cap, the cap is configured to mount to the aerator in a closed position to close the fluid outlet and air inlet, and the cap is detachable from the aerator to permit fluid to dispense from the aerator.

14. The apparatus of claim 8, wherein the body is formed from a metallic material and the body is tapered along a substantially entire axial length thereof, and the external seal is adapted to slidingly and temporarily engage the opening in the container.

15. The apparatus of claim 8, wherein a freezing point of the second fluid is in a range of about −1° C. to about −30° C.

16. The apparatus of claim 8, wherein the body varies in axial sectional shape, such that an exterior surface of the body undulates, and the cavity is tapered along a substantially entire axial length thereof.

17. The apparatus of claim 8, wherein the body has a first radial wall thickness (Rb), and the body has a radial wall thickness at the cavity (Rc) that is less than (Rb) by at least about 10%;

the (Rc) varies along the cavity in the axial direction, the cavity comprises radially wide portions and radially narrow portions, with respect to the axis; and the (Rc) is greater in the radially narrow portions and the (Rc) is less in the radially narrow portions.

18. An apparatus for aerating and dispensing fluid from a container, the apparatus comprising:

a body comprising an aerator having a fluid inlet, a fluid outlet, an air inlet and an air outlet, the aerator having a fluid channel extending between the fluid inlet and the fluid outlet and configured to extend out of the container, the air inlet is configured to flow air to the air outlet and into the container, and a passage is configured to flow at least a portion of the air from the air inlet into the fluid channel to aerate the fluid;

an external seal on the body configured to engage and seal an opening in the container; and a cap configured to mount to the aerator in a closed position to close the fluid outlet and air inlet, and the cap is detachable from the aerator to permit fluid to dispense from the aerator.

19. The apparatus of claim 18, wherein the body is tapered along a substantially entire axial length thereof.

* * * * *